US009466914B2

(12) United States Patent
Takamura et al.

(10) Patent No.: US 9,466,914 B2
(45) Date of Patent: Oct. 11, 2016

(54) WATERPROOF CONNECTOR

(71) Applicant: Yazaki Corporation, Tokyo (JP)

(72) Inventors: Naoki Takamura, Susono (JP); Daisuke Miyakawa, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/797,488

(22) Filed: Jul. 13, 2015

(65) Prior Publication Data

US 2016/0020548 A1 Jan. 21, 2016

(30) Foreign Application Priority Data

Jul. 17, 2014 (JP) ..... 2014-146381

(51) Int. Cl.
*H01R 13/40* (2006.01)
*H01R 13/52* (2006.01)
*H01R 13/504* (2006.01)

(52) U.S. Cl.
CPC ..... *H01R 13/5202* (2013.01); *H01R 13/504* (2013.01); *H01R 13/5208* (2013.01)

(58) Field of Classification Search
CPC ..... H01R 13/5202; H01R 13/5208; H01R 13/504; H01R 13/631; H01R 13/5221; H01R 13/521; H01R 13/4361
USPC ..... 439/587
See application file for complete search history.

(56) References Cited

U.S. PATENT DOCUMENTS 7,249,958 B2 * 7/2007 Ishikawa ..... H01R 13/631 439/140
7,419,395 B2 * 9/2008 Tsuji ..... H01R 13/5221 439/271
7,997,917 B1 * 8/2011 O'Neill ..... H01R 13/5208 439/275
8,066,518 B2 * 11/2011 Homme ..... H01R 13/5202 439/78
8,366,472 B2 * 2/2013 Miyamoto ..... H01R 13/4361 439/345
8,485,838 B2 * 7/2013 Kataoka ..... H01R 13/521 439/271
8,491,323 B2 * 7/2013 Ishibashi ..... H01R 13/5221 439/205
8,734,174 B2 * 5/2014 Nakamura ..... H01R 13/504 439/271
8,882,530 B2 * 11/2014 Matsumura ..... H01R 13/62977 439/372

FOREIGN PATENT DOCUMENTS

JP 2012-069471 A 4/2012

* cited by examiner

*Primary Examiner* — Jean F Duverne
(74) *Attorney, Agent, or Firm* — Locke Lord LLP; James E. Armstrong, IV; Brian S. Matross

(57) ABSTRACT

Provided is a waterproof connector capable of reducing water-stopping warranty portions. A waterproof connector is configured to include an outer housing, an inner housing, a terminal-equipped with electrical wire, and a packing mat seal. In a bottom wall of the outer housing, a locking projection on the left side and a locking projection on the right side served as engagement part with respect to the inner housing are integrally formed. Further, in the bottom wall in the outer housing, the packing mat seal is integrally molded so as to adhere to circumferential surfaces of proximal end sides in the locking projection on the right side and the locking projection on the left side. An integral molding of the packing mat seal provides a watertight property between a packing mat seal and the circumferential surfaces of the proximal end sides in the locking projection and the locking projection.

2 Claims, 12 Drawing Sheets

WATERPROOF CONNECTOR

TECHNICAL FIELD

The present invention relates to waterproof connectors each of which comprised of an outer housing, an inner housing, a plurality of electrical wire-equipped terminals, and a packing mat seal.

BACKGROUND ART

In the following patent literature 1, a technique related to a conventional waterproof connector is disclosed. In FIGS. 10 to 12, a waterproof connector 101 is adapted to include an outer housing 102 made of resin, an inner housing 103 made of resin, the electrical wire-equipped terminals that are not shown in the figures, and a packing mat seal 104 made of silicone rubber.

The outer housing 102 is comprised of a hood portion 105 to be engaged with a mating connector that is not shown in the figures via a front opening, and a bottom wall 106 formed and disposed at a rear end position of the hood portion 105. In the inner housing 103, there is formed thereinside an accommodation chamber which accommodates a plurality of terminal fittings of the electrical wire-equipped terminals that are not shown in the figures. In a rear wall 107 of the inner housing 103, there are formed locking projections 108 to be hooked and engaged by the bottom wall 106. The packing mat seal 104 is formed in a thick plate shape, and is provided at the bottom wall 106 of the outer housing 102. The packing mat seal 104 is sandwiched between the bottom wall 106 and the rear wall 107 of the inner housing 103. In the packing mat seal 104, there is formed a water-stopping structure 109 (a seal lip or the like) to be adhered to electrical wires connected to the terminal fittings accommodated in the accommodation chambers. Further, in the packing mat seal 104, there is also formed a water-stopping structure 110 with respect to the locking projections 108 of an inner housing 3.

In the foregoing configurations and structures, when the packing mat seal 104 is provided at the bottom wall 106 of the outer housing 102, and subsequently the inner housing 103 is inserted into the hood portion 105 of the outer housing 102, the locking projections 108 of the inner housing 103 are inserted into the water-stopping structure 110 of the packing mat seal 104. Then, when the locking projections 108 are hooked by the bottom wall 106 of the outer housing 102 penetrating the water-stopping structure 110, an integration of the outer housing 102 and the inner housing 103 is accomplished.

CITATION LIST

Patent Literature

Patent Literature 1: JP 2012-69471 A

SUMMARY OF INVENTION

Technical Problem

In the aforementioned conventional art, there is a problem of needing many places to warrant water-stopping, since not only water-stopping structure 109 with respect to the electrical wire-equipped terminals that are not shown in the figures, but also the water-stopping structure 110 with respect to the locking projections 108 of the inner housing 103 is made necessary therein.

The present invention has been made under the above circumstance, and aims to provide a waterproof connector in which the number of portions to be warranted a water-stopping property can be reduced.

Solution to Problem

A waterproof connector of a first aspect of the present invention for attaining the above objectives, provides a waterproof connector comprising: an outer housing comprised of a hood portion to be engaged with the mating connector via a front opening and a bottom wall formed and disposed in a rear end position of the hood portion; an inner housing comprised of accommodation chambers and being engaged with the outer housing when inserted into an inside of the hood portion; a plurality of electrical wire-equipped terminals comprised of a plurality of terminal fittings accommodated in the accommodation chambers and electrical wire terminals connected to the plurality of terminal fittings; and a packing mat seal in a thick plate shape disposed between the bottom wall and the inner housing, and respectively water-tightly sealing the bottom wall, the inner housing, and the plurality of electrical wire-equipped terminals, wherein a locking projection having an arm portion protruding toward the front opening, an engagement convex portion disposed in a protrusion tip side of the arm portion and locking the inner housing, and a mat seal-embedded portion continuous with a proximal end portion of the arm portion is integrally formed to the bottom wall, and wherein the packing mat seal is integrally molded to the bottom wall so as to adhere to a circumferential surface of the mat seal-embedded portion.

According to the present invention thus characterized, the outer housing is configured by integrally forming the locking projection served as an engagement part with the inner housing, with the bottom wall. Further, the packing mat seal is configured by integrally molded to the bottom wall of the outer housing from which the locking projection is protruding. When the packing mat seal is integrally molded to the bottom wall, the locking projection becomes in a state such that the packing mat seal adheres to the circumferential surface of the mat seal-embedding portion. That is, a water-stopped state. The present invention is not adopting the conventional water-stopping structure such that the locking projection is inserted into the packing mat seal and is subjected to penetrate therethrough.

A preferred aspect of the present invention provides the waterproof connector according to the first aspect of the present invention, wherein the locking projection is respectively formed and arranged in vicinities of inner surfaces of a pair of mutually-opposing side walls in the outer housing, sidewall opening portions served as punch-out portions for forming the engagement convex portion outwardly are respectively formed in the pair of side walls, and one of the sidewall opening portions is formed also as an assembly part for a spacer inserted into the inner housing so as to traverse the accommodation chambers, the assembly part of the spacer being further provided in the connector.

According to the present invention thus characterized, when the spacer is inserted via sidewall opening portion of the outer housing after the terminal fittings being accommodated in the accommodation chambers in the inner housing, the terminal fittings become to be double-locked. Meanwhile, in the present invention, a water-stopping property with respect to the mating connector can be obtained by forming the same seal lip as the conventional art on the side circumferential surface of the packing mat seal. This seal lip enables water-stopping with respect to the mating connector. Thus, even when the sidewall opening portion is formed in the outer housing like the present invention, a water-stopping property is not influenced thereby.

Advantageous Effects of Invention

According to the first aspect of the present invention, an effect capable of reducing water-stopping warranty in connection with the engaging parts of the outer housing and the inner housing can be provided.

According to the second aspect of the present invention, the following effect in addition to the effect by the first aspect of the present invention can be provided: that is, an effect capable of adding the double locking structure for the terminal fittings.

DESCRIPTION OF EMBODIMENTS

A waterproof connector is comprised of an outer housing, an inner housing, a plurality of electrical wire-equipped terminals, and a packing mat seal, and a locking projection served as an engaging portion with the inner housing is integrally formed in a bottom wall of the outer housing. Further, the packing mat seal is integrally formed at the bottom wall of the outer housing so as to adhere to a circumferential surface of a proximal end side of the locking projection. The integral molding of the packing mat seal achieves a water-seal function between the circumferential surface of the proximal end side of the locking projection and the packing mat seal.

Embodiments

Figure 1:
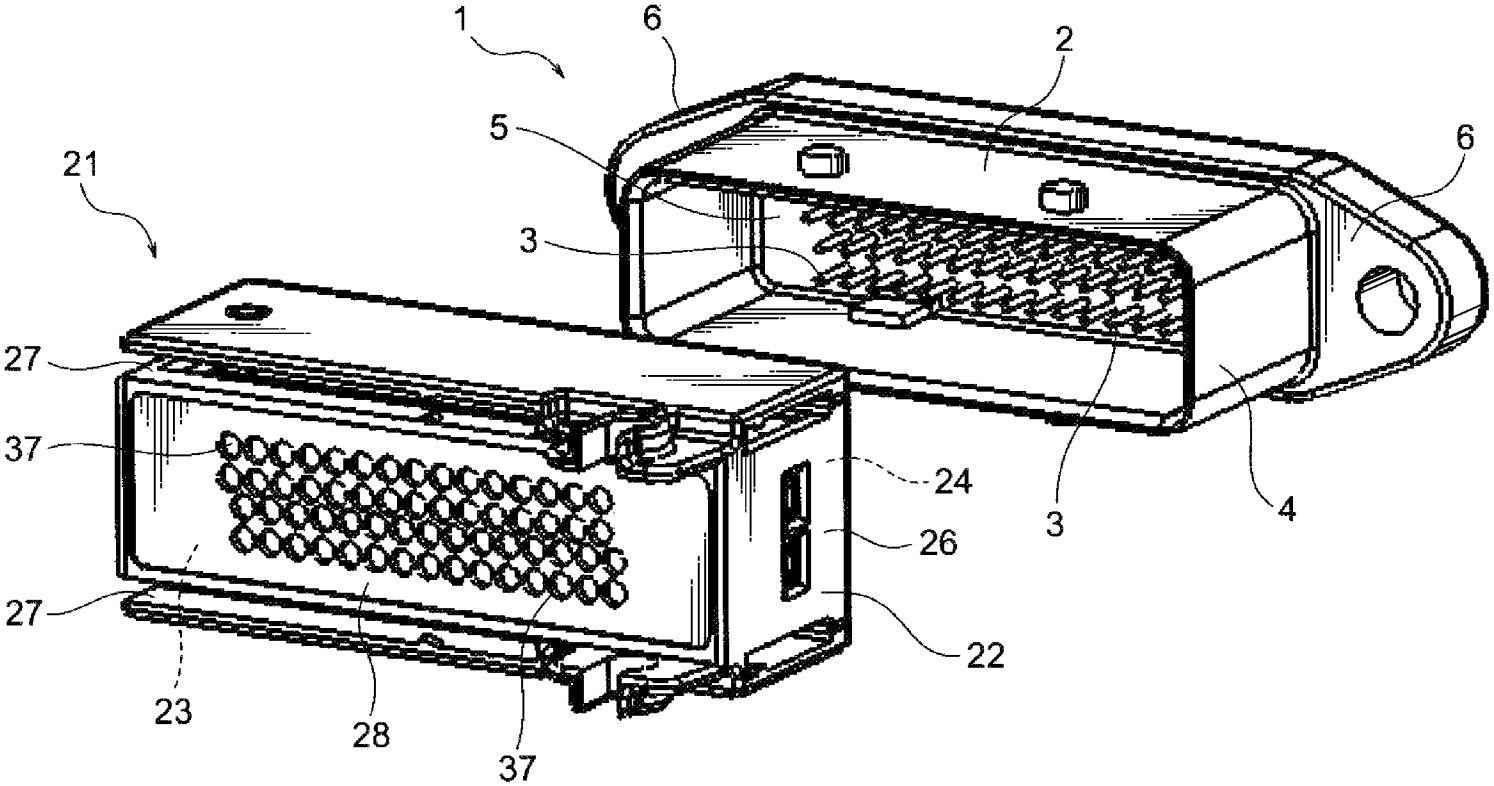
FIG. 1 is a perspective view showing a state immediately before an engagement between a waterproof connector and a mating connector.
Figure 2:
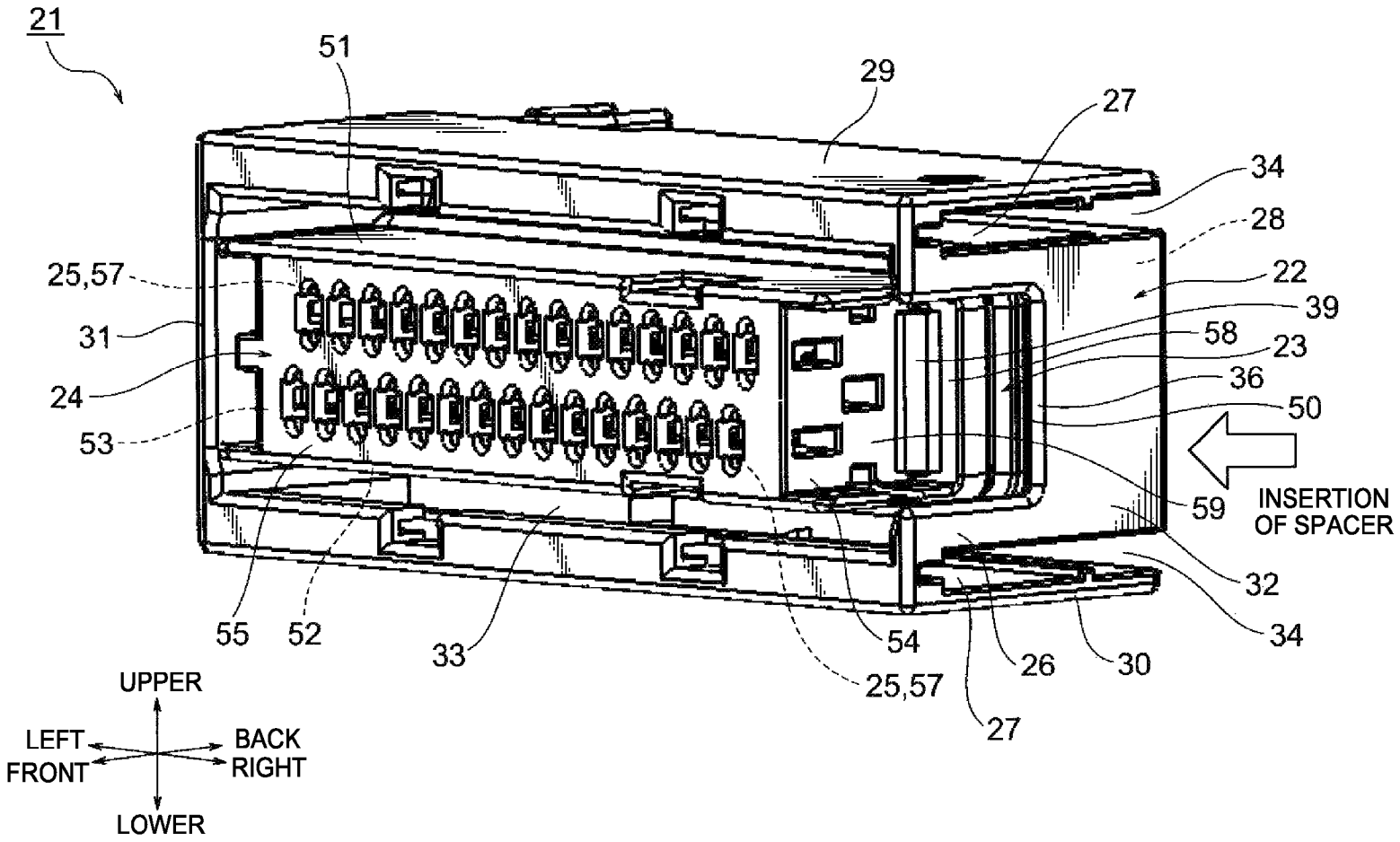
FIG. 2 is a perspective view showing a front face of a waterproof connector in FIG. 1.
Figure 3:
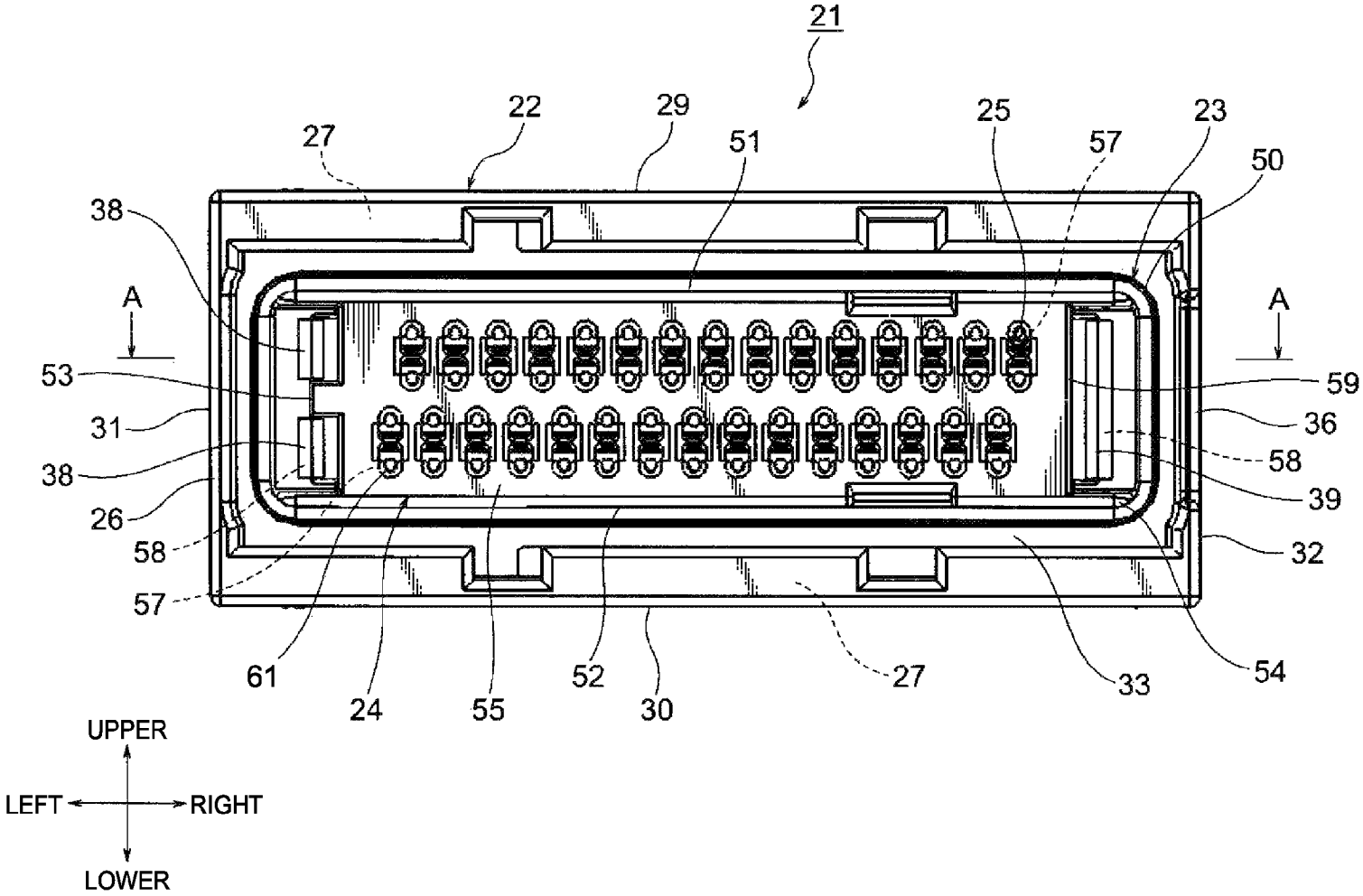
FIG. 3 is a front-elevational view of a waterproof connector.
Figure 4:
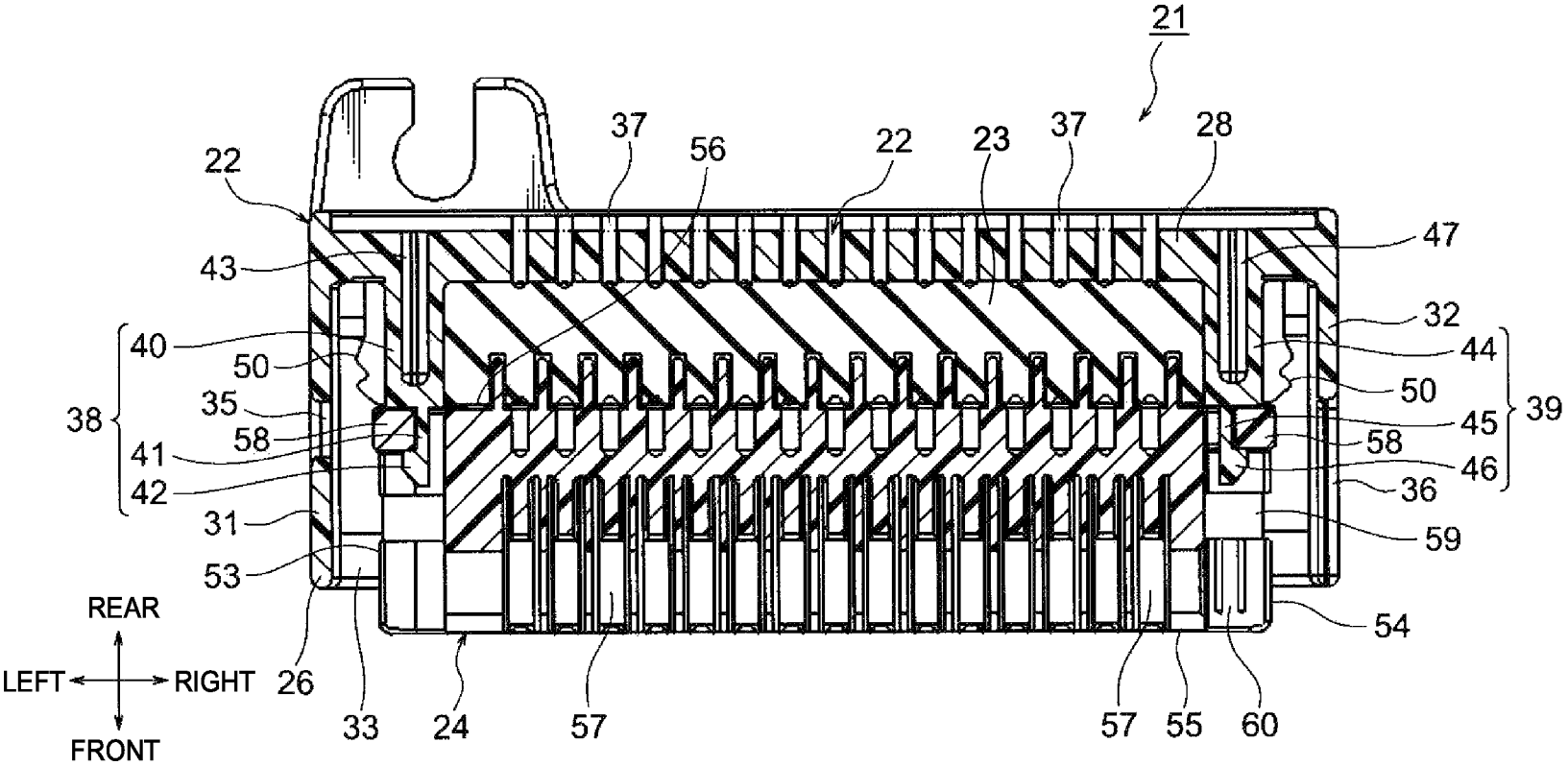
FIG. 4 is a cross-sectional view taken along an A-A line in FIG. 3.
Figure 5:
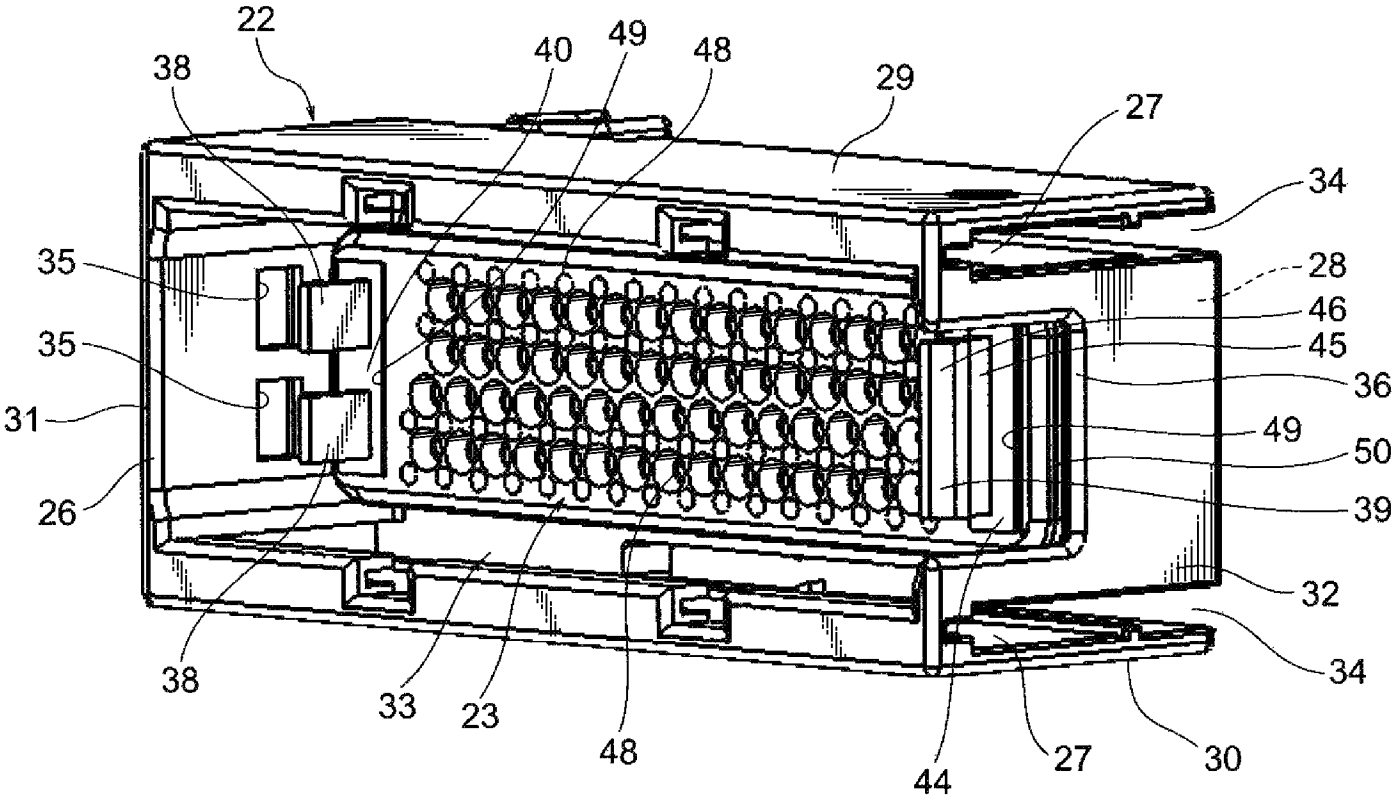
FIG. 5 is a perspective view showing a state where a packing mat seal is integrally molded to an outer housing.
Figure 6:
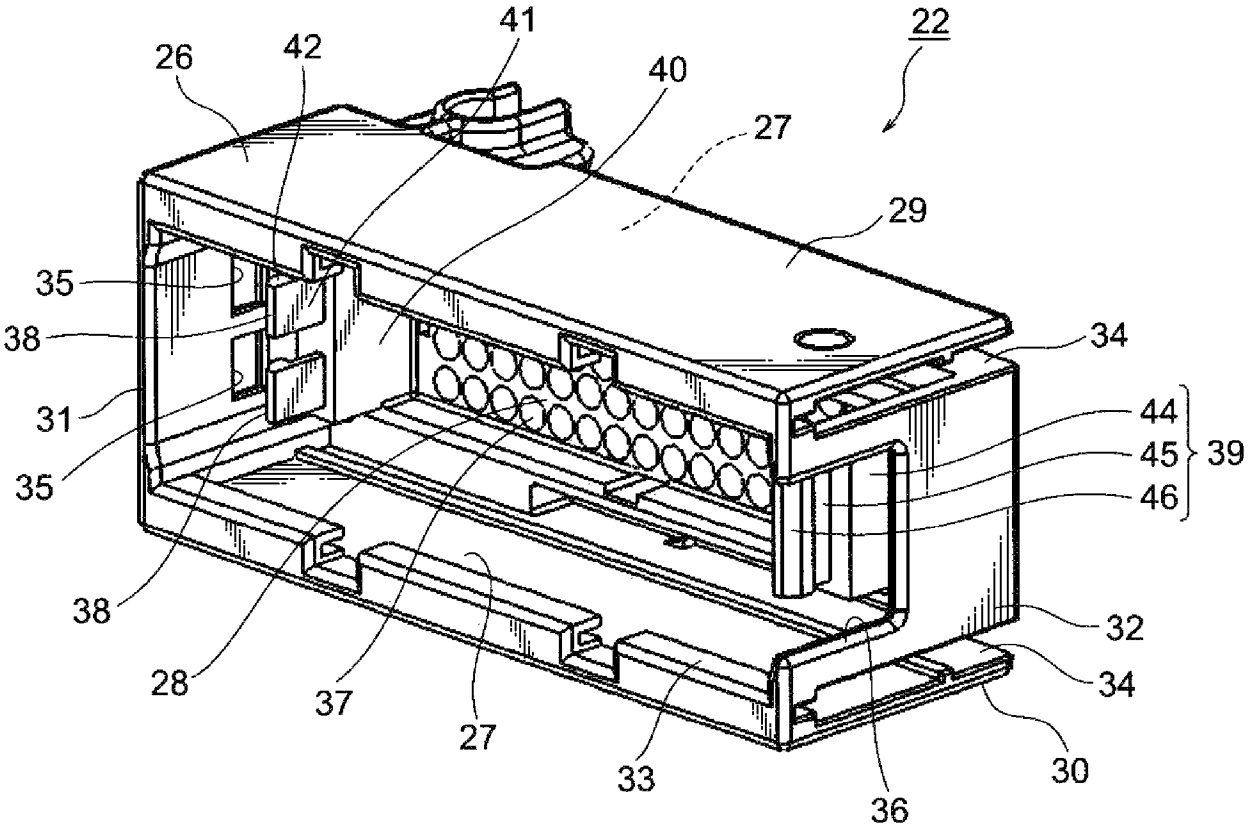
FIG. 6 is a perspective view showing only an outer housing from the state in FIG. 5.
Figure 7:
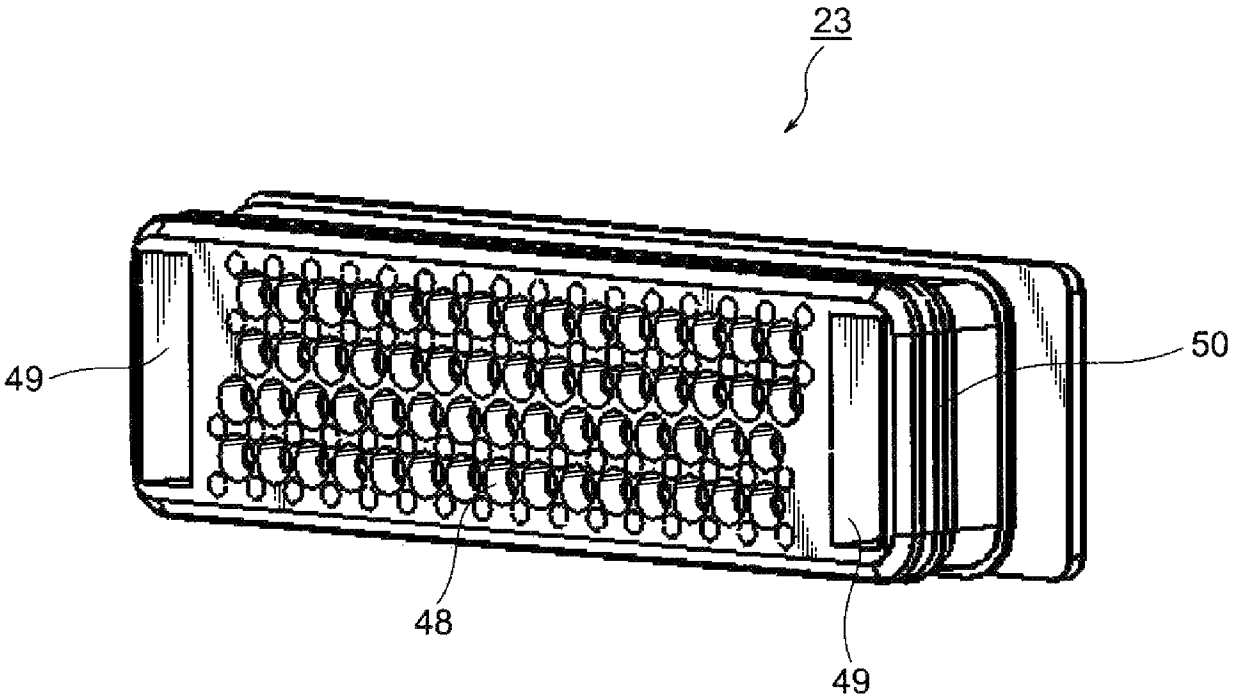
FIG. 7 is a perspective view showing only a packing mat seal from the state in FIG. 5.
Figure 8:
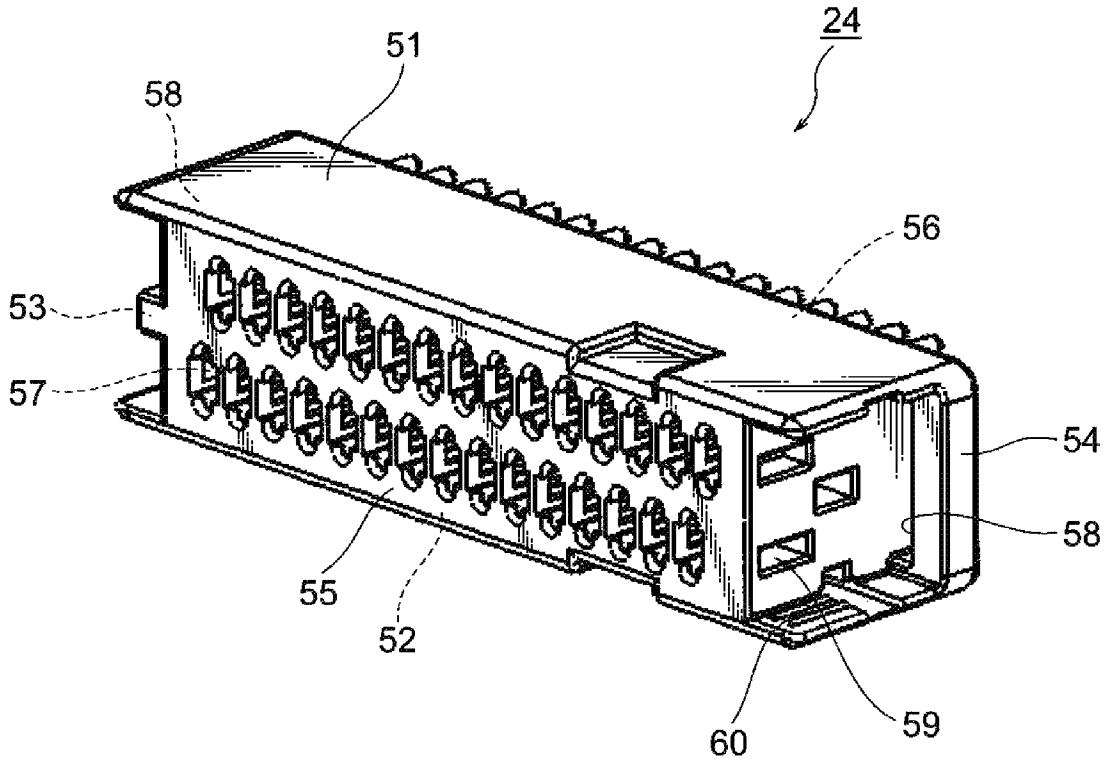
FIG. 8 is a perspective view of an inner housing.
Figure 9:
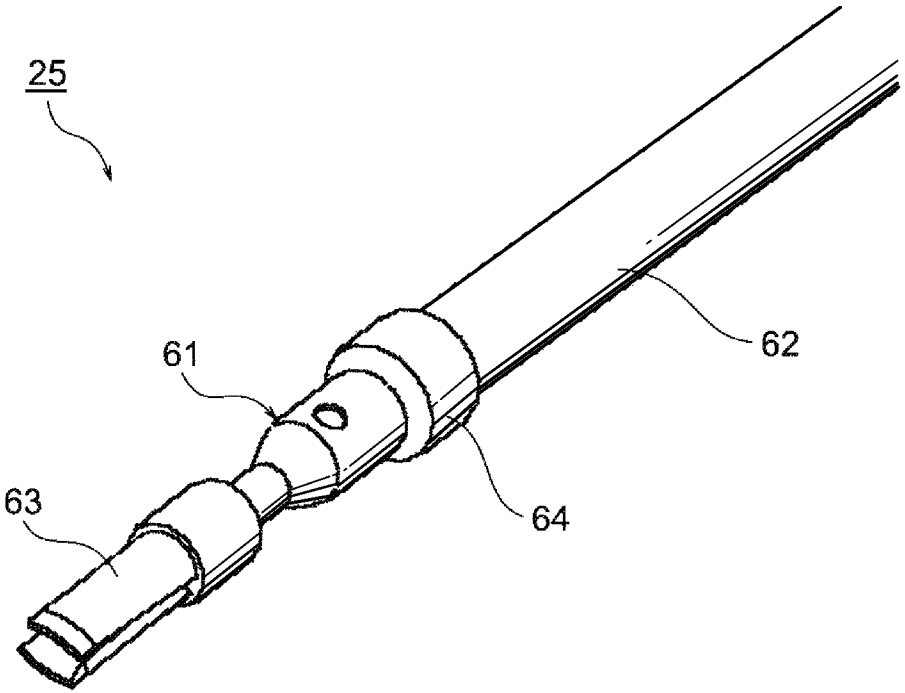
FIG. 9 is a perspective view of an electrical wire-equipped terminal.
Figure 10:
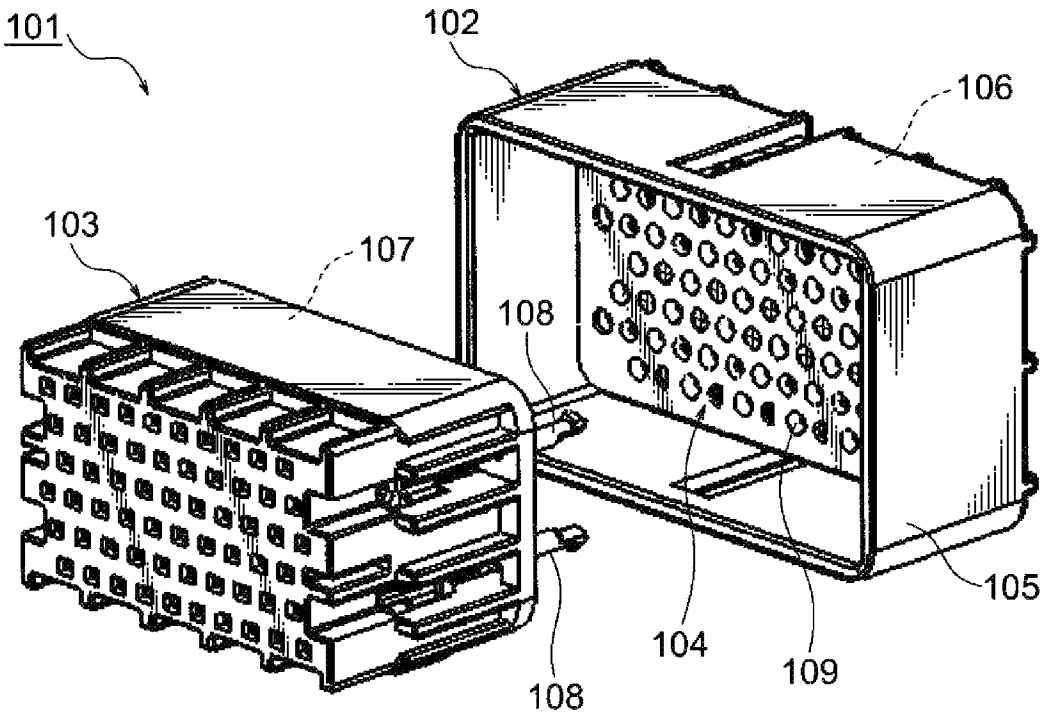
FIG. 10 PRIOR ART
FIG. 10 is an exploded perspective view of a conventional waterproof connector.
Figure 11:
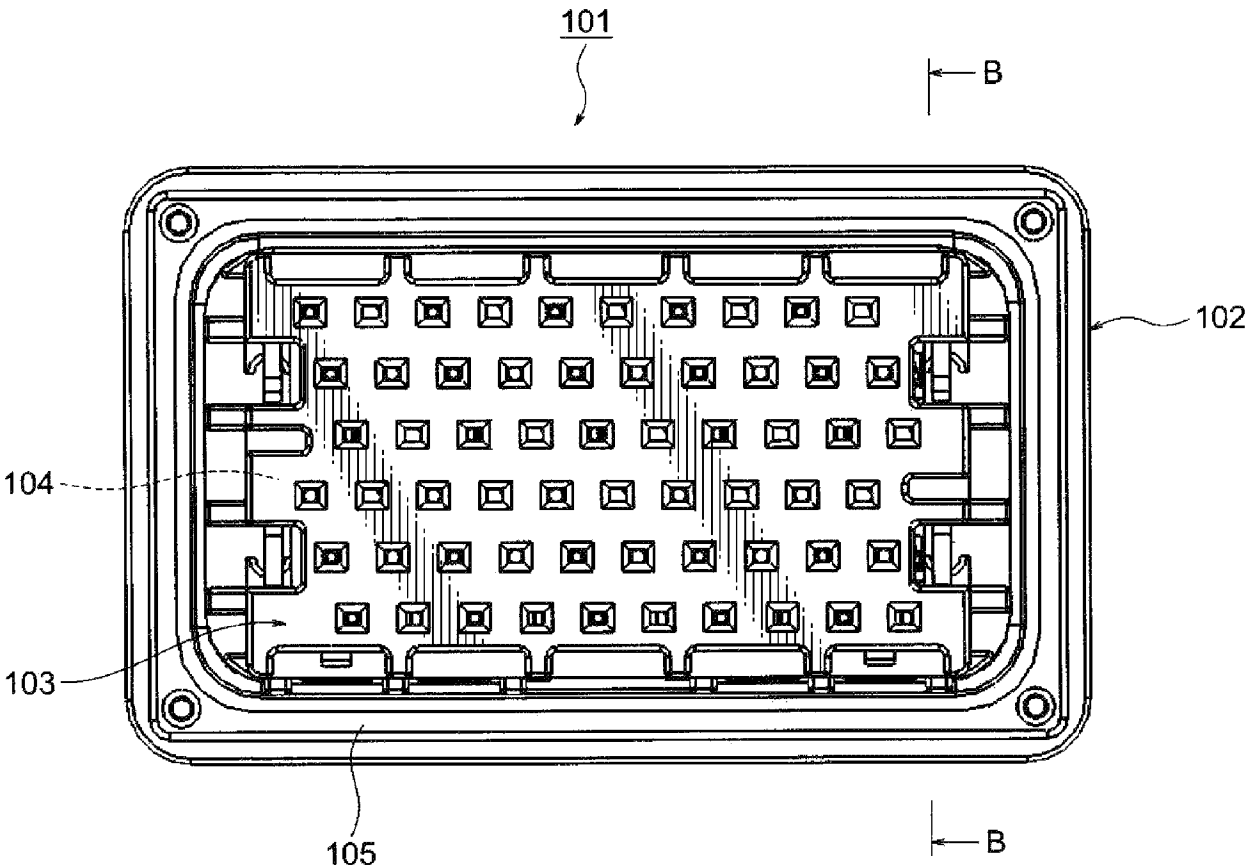
FIG. 11 PRIOR ART
FIG. 11 is a front-elevational view of the waterproof connector in FIG. 10.
Figure 12:
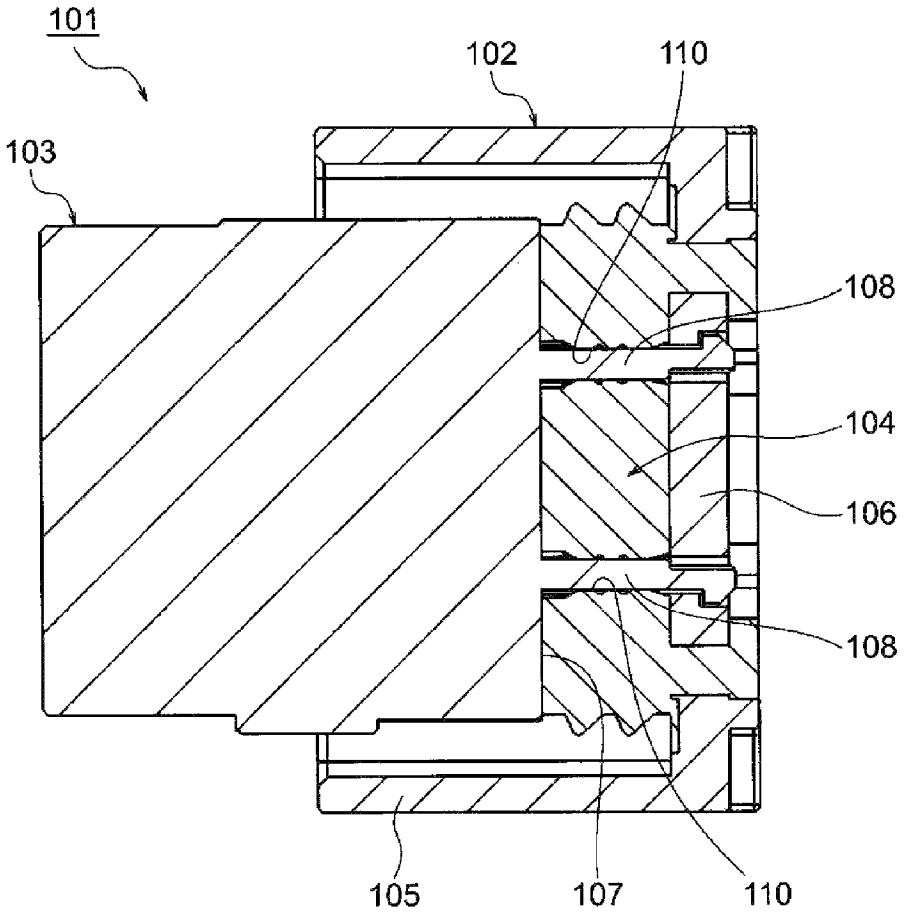
FIG. 12 PRIOR ART
FIG. 12 is a cross-sectional view taken along a B-B line in FIG. 11.

Hereinafter, the examples are described in reference with the figures. FIG. 1 is the perspective view showing the state immediately before the engagement between the waterproof connector and the mating connector. Further, FIG. 2 is the perspective view showing a front face of the waterproof connector in FIG. 1, FIG. 3 is the front-elevational view of the waterproof connector, FIG. 4 is the cross-sectional view taken along the A-A line in FIG. 3, FIG. 5 is the perspective view showing the state where the packing mat seal is integrally molded with the outer housing, FIG. 6 is the perspective view showing only the outer housing from the state in FIG. 5, FIG. 7 is the perspective view showing only the packing mat seal from the state in FIG. 5, FIG. 8 is the perspective view of the inner housing, and FIG. 9 is the perspective view of the electrical wire-equipped terminal.

In FIG. 1, the reference number 21 indicates the waterproof connector of the present invention. Also, the reference number 1 indicates an electrical mating connector (a mating engagement component) for the waterproof connector 21. The waterproof connector 21 and the mating connector 1 are herein to be described as serving as a multipolar connector. Incidentally, in a practical circumstance, a number of electrical wires are lead out from the waterproof connector 21 and the mating connector 1, illustrating the electrical wires in the figures is omitted as a matter of convenience.

Firstly, the mating connector 1 is preferentially described.

The connector 1 is a well-known art, and is configured to include a connector housing 2, and a number of male terminal fittings 3 to be accommodated in the connector housing 2. The connector housing 2 is formed in a shape as shown in the figures in which a hood portion 4, a bottom wall 5, and a flange portion 6 are formed in an integral fashion. The hood portion 4 is formed such that a front face thereof opens. In a rear end position of the hood portion 4, the bottom wall 5 is formed and disposed. In a circumferential surface of the hood portion 4, there is formed a lever engagement part (the reference number thereof is omitted, a part with which a non-illustrated lever that will be described later is engaged). Each of the male terminal fittings 3 is comprised of a pin-like shaped electrical contact portion protruding from the bottom wall 5 and the electrical wire connection portion continuous with the electrical contact portion, and being connected to an electrical wire terminal.

Next, the waterproof connector 21 of the present invention is described. The arrows in the figures respectively indicate a vertical direction, a crosswise direction, and a front-back direction (these directions are one example).

In FIGS. 1-4, the waterproof connector 21 is configured to include an outer housing 22, a packing mat seal 23, an inner housing 24, a number of terminals-equipped with electrical wire 25 (refer to FIG. 9), a lever that is not shown in the figures, and a spacer that is not shown in the figures.

Since the waterproof connector 21 serves as the multipole connector as aforementioned, an insertion-extraction can be carried out under a low power by a function of a non-illustrated lever provided therewith. The waterproof connector 21 in this embodiment is a connector having an LIF mechanism. Further, the waterproof connector 21 can double-lock the female terminal fittings 61 that will be described later by a function of a non-illustrated spacer. As such, the waterproof connector 21 in this embodiment is also a connector having a terminal double-locking structure.

The waterproof connector 21 includes, as will be described in detail in the following, a structure such that the packing mat seal 23 is integrally molded to the outer housing 22. Also, with respect to the outer housing 22 integrally molded with the packing mat seal 23, the waterproof connector 21 includes a structure so as to be engaged with the outer housing 22 with being sealed.

In FIGS. 1-6, the outer housing 22 is a molded resin product having an insulation property, and is formed in a shape as shown in the figures, in which a hood portion 26, a pair of lever assembly parts 27, and a bottom wall 28 are provided. The outer housing 22 is what is called a connector housing. Further, the bottom wall 28 is, as will be described later, what is called a rear wall.

The hood portion 26 is formed as a portion in a rectangular and substantially tubular shape having an upper wall 29, a lower wall 30, a left wall 31, and a right wall 32. The hood portion 26 is formed as a portion such that the hood portion 4 of the mating connector 1 is inserted thereinto and engaged therewith. In insides of the upper wall 29 and the lower wall 30, the lever assembly part 27 is continuously formed therewith respectively. The lever assembly part 27 is formed as a portion to which a lever that is not shown in the figures is assembled. Further, the lever assembly part 27 is formed as a portion configuring the aforementioned LIF mechanism. The lever assembly part 27 is also formed such that a pair of slits 34 is respectively produced in the left wall 31 and the right wall 32.

In the left wall 31, there is formed a pair of sidewall opening portions 35. The pair of sidewall opening portions 35 is formed such that the left wall 31 is penetrated with a rectangular shape. Further, the pair of sidewall opening portions 35 is formed to align to positions of engagement convex portions 42 of locking projections 38 on the left side as will be described later. The sidewall opening portions 35 are formed as, in this embodiment, punch-out portions for forming the engagement convex portions 42 outwardly.

In the right wall 32, in addition to the aforementioned slits 34, a sidewall opening portion 36 is formed. The sidewall opening portion 36 is formed such that the right wall 32 is penetrated with a large rectangular shape. Further, the sidewall opening portion 36 is formed to align to a position of an engagement convex portion 46 of a locking projection 39 on the right side as will be described later. The sidewall opening portion 36 is formed as, in this embodiment, a punch-out portion for forming the engagement convex portion 46 outwardly. Besides, the sidewall opening portion 36 is formed so as to be cut out until reaching a position of a front opening 33 of the hood portion 26. By being cut out up to the position of the front opening 33, the sidewall opening port is also formed as an assembly part for a spacer that is not shown in the figures. By the sidewall opening portion 36 being formed, a portion into which a spacer is inserted in the inner housing 24 can be defined. In other words, even after the inner housing 24 being accommodated in and engaged with the outer housing 22, an assembly of the spacer can be carried out via the sidewall opening portion 36.

The bottom wall 28 is disposed at a rear portion of the outer housing 22. That is, the bottom wall 28 is what is called a rear wall, thus, in the bottom wall 28, a number of electrical wire lead-out portions 37 are formed so as to penetrate therethrough in the front-back direction. An inner surface of such a bottom wall 28 is formed as a surface with which the packing mat seal 23 is integrated. Further, on the inner surface of the bottom wall 28, there are integrally formed therewith, the locking projections 38 on the left side and the locking projection 39 on the right side. The locking projections 38 on the left side and the locking projection 39 on the right side are respectively formed so as to enable an engagement with the inner housing 24 through the packing mat seal 23. The locking projections 38 on the left side are formed and disposed in a vicinity of the inner surface of the left wall 31. The locking projection 39 on the right side is formed and disposed in a vicinity of the inner surface of the right wall 32. The locking projections 38 on the left side and the locking projection 39 on the right side are formed so as to protrude toward the front opening 33 (forward) of the hood portion 26.

The locking projections 38 on the left side are formed in a shape as illustrated in the figures, in which a mat seal-embedded portion 40 to be integrated with an inner surface of the bottom wall 28, a pair of arm portions 41 protruding from the mat seal-embedded portion 40, and the engagement convex portions 42 disposed on the protruding tip side of the arm portion 41 are provided. The mat seal-embedded portion 40 is a rectangular-block shaped portion, and is formed such that the packing mat seal 23 adheres tightly to the circumferential surface thereof when the packing mat seal 23 is integrated to the bottom wall 28. Meanwhile, the reference number 43 in the mat seal-embedded portion 40 indicates a thickness reduction portion for stabilizing a resin-molding process (refer to FIG. 4).

The pair of arm portions 41 is formed as a cantilevered plate-like portion having flexibility. The pair of arm portions 41 is arranged with a predetermined interval therebetween. The engagement convex portion 42 is formed as a protrusion portion in an approximately triangular cross-sectional shape that engages with a left side of the inner housing 24. The engagement convex portion 42 is formed in a manner protruding outwardly.

The locking projection 39 on the right side is formed in a shape as illustrated in the figures, in which a mat seal-embedded portion 44 to be integrated with an inner surface of the bottom wall 28, an arm portion 45 protruding from the mat seal-embedded portion 44, and the engagement convex portion 46 disposed on the protruding tip side of the arm portion 45 are provided. The mat seal-embedded portion 44 is a rectangular-block shaped portion, and is formed such that the packing mat seal 23 adheres tightly to the circumferential surface thereof when the packing mat seal 23 is integrated to the bottom wall 28. The reference number 43 in the mat seal-embedded portion 40 indicates a thickness reduction portion for stabilizing the resin-molding process. The thickness reduction portion 47 (refer to FIG. 4) is also formed in the mat seal-embedded portion 44.

The arm portion 45 is formed as a cantilevered plate-like portion having flexibility. The arm portion 45 is formed to have a larger width than the pair of arm portions 41 in the locking projections 38 on the left side. The engagement convex portion 46 is formed as a protrusion portion in an approximately triangular cross-sectional shape that engages with a right side of the inner housing 24. The engagement convex portion 46 is formed in a manner protruding outwardly.

In FIGS. 4, 5, and 7, the packing mat seal 23 is a seal member integrally molded to the bottom wall 28 of the outer housing 22 as aforementioned, and is formed in a thick-plate shape. Materials used for the packing mat seal 23 can be the well-known silicone rubber or the like but is not limited thereto (Materials such as those having an adhesive property to the outer housing 22, while not having an adhesive property to a molding die that is not shown is preferably used). Meanwhile, FIG. 7 depicts the packing mat seal 23, but this is actually used in such an integral manner as shown in FIG. 5, and is supposed not to be a single component here.

In the packing mat seal 23, there are formed a number of an insertion holes 48, and a pair of locking projection-adhering portions 49. Each of the insertion holes 48 is formed as a portion to which an electrical wire 62 (will be described later) is penetrated therethrough; the electrical wire 62 being inserted into the electrical wire lead-out portion 37 of the bottom wall 28 in the outer housing 22. In an inner surface of such an insertion holes 48, there is formed an inner circumferential lip (an annular seal lip). The inner circumferential lip is a portion that water-tightly adheres to an outer surface of the electrical wire 62 by means of an elasticity of the packing mat seal 23. Therefore, a water-stopping property at this portion can be justifiably warranted.

The pair of locking projection-adhering portions 49 is a portion which adheres to, in the outer housing 22, the mat seal-embedded portion 40 of the locking projections 38 on the left hand, or the mat seal-embedded portion 44 of the locking projection 39 on the right hand, and is produced by molding of the packing mat seal 23. Since the pair of locking projection-adhering portions 49 adheres to the mat seal-embedded portions 40, 44 by molding, it can be seen that the pair of locking projection-adhering portions 49 is not a water-stopping structure formed by insertion.

On the side circumferential surface of the packing mat seal 23, a seal lip 50 is provided. The seal lip 50 is formed as an outer circumferential lip (an annular seal lip). When an inner surface of a front end tip portion of the hood portion 4 in the mating connector 1 adheres to the seal lip 50, a water-stopping property at this portion is established.

In FIGS. 2, 3, 4 and 8, the inner housing 24 is a resin molded component having an insulation property, and is formed in a rectangular, and an approximately box-like shape comprised of an upper wall 51, a lower wall 52, a left wall 53, a right wall 54, a front wall 55 and a rear wall 56. In the inner housing 24, a number of terminal accommodation chambers 57 are formed. Further, in the inner housing 24, there are formed a pair of engaged portions 58 and a spacer assembly part 59. Meanwhile, a well-known structure is assumed to be adopted with respect to the terminal accommodation chambers 57, and their explanatory descriptions are therefore omitted here. The inner housing 24 is what is called a connector housing.

The pair of engaged portions 58 is respectively hooked by the locking projections 38 on the left side of the outer housing 22 and the locking projection 39 on the right side thereof, and is therefore formed as a portion with which the inner housing 24 is likely to be engaged. More specifically, the pair of engaged portions 58 is formed in such a shape that the locking projections 38 (the pair of arm portions 41) on the left side and the locking projection 39 (the arm portion 45) on the right side are likely to be inserted thereinto from the rear wall 56 side. Further, the pair of engaged portions 58 is formed so as to be in a bridge-like shape as viewed from the left wall 53 and the right wall 54 sides. The portions formed to be in a bridge-like shape are formed as portions hooked by the pair of the engagement convex portions 42 and the engagement convex portion 46.

The pair of engaged portions 58 is formed in a positional relationship where the rear wall 56 adheres to the packing mat seal 23 when an engagement between the outer housing 22 and the inner housing 24 is carried out.

The spacer assembly part 59 is formed as a portion to which a spacer that is not shown is assembled. The spacer assembly part 59 is formed as a portion capable of an assembly such that an insertion of the spacer is started from the right wall 54, then the spacer is moved across the terminal accommodation chambers 57, and finally, an insertion end tip of the spacer protrudes from the left wall 53. In this embodiment, although the illustration of the spacer is omitted, the spacer is assumed to be formed in a shape capable of performing a function that is equivalent to a known one. Meanwhile, the reference number 60 in the spacer assembly part 59 of the right wall 54 indicates an engagement part with respect to the spacer.

The spacer assembly part 59 is formed and disposed in a position capable of being faced from the sidewall opening portion 36 of the right wall 32 in a state where the inner housing 24 is accommodated in and inserted into the outer housing 22.

In FIG. 9, the terminal-equipped with electrical wire 25 is configured with the female terminal fitting 61 (terminal fitting) is accommodated in each of the terminal accommodation chambers 57 (refer to FIG. 4) in the inner housing 24, and a terminal portion of the electrical wire 62 to which the female terminal fitting 61 is connected. The female terminal fitting 61 is formed in a shape as illustrated in the figure by processing metal plate having electrical conductivity. The female terminal fitting 61 is comprised of an electrical contact portion 63 as a female side into which the electrical contact portion in a pin-like shape of the male terminal fitting 3 is inserted, and an electrical wire connection portion 64 continuous with the electrical contact portion 63.

Subsequently, an assembly of the waterproof connector 21 of the present invention is described on the basis of the aforementioned configurations and structures.

In FIG. 6, the resin-molding process is implemented using the molding die that is not shown in the figure so as to form the outer housing 22. After the outer housing 22 having being formed, metal die for shaping an inner configuration of the outer housing 22 is replaced thereby, thereafter the packing mat seal 23 is integrally formed on the bottom wall 28 of the outer housing 22 (refer to FIG. 5). The integral formation of the packing mat seal 23 causes respective protrusions of the locking projections 38 on the left side and the locking projection 39 on the right side of the outer housing 22 from this packing mat seal 23.

When the inner housing 24 which has been resin-formed in other process is inserted into the outer housing 22, the locking projections 38 on the left side and the locking projection 39 on the right side of the outer housing 22 are respectively inserted into the pair of engaged portions 58 in the inner housing 24, and subsequently, when the bridge-shaped portion of the pair of engaged portions 58 is respectively hooked by the engagement convex portions 42 of the locking projections 38 on the left side and the engagement convex portion 46 of the locking projection 39 on the right side, the inner housing 24 becomes engaged with the outer housing 22.

As can be seen from the aforementioned configurations and structures, the locking projections 38 on the left side and the locking projection 39 on the right side that are used for engaging portions with respect to the outer housing 22 and the inner housing 24 are subjected to be water stopped, these are therefore not portions where a water-stopping property with respect to electrical wires should be warranted unlike the insertion holes 48 of the packing mat seal 23. Thus, according to the present invention, there is provided such an effect as that the number of portions to be warranted a water-stopping property can be reduced as compared to the conventional arts.

The present invention can be naturally implemented in any varied or modified forms within the gist of the present invention.

REFERENCE SIGNS LIST

1 mating connector
2 connector housing
3 male terminal fitting

4 hood portion
5 bottom wall
6 flange portion
21 waterproof connector
22 outer housing
23 packing mat seal
24 inner housing
25 electrical wire-equipped terminal
26 hood portion
27 lever assembly part
28 bottom wall
29 upper wall
30 lower wall
31 left wall
32 right wall
33 front opening
34 slit
35 sidewall opening portion
36 sidewall opening portion (spacer assembly part)
37 electrical wire lead-out portion
38 locking projection on left side (engagement protrusion)
39 locking projection on right side (engagement protrusion)
40, 44 mat seal-embedded portion
41, 45 arm portion
42, 46 engagement convex portion
43, 47 thickness reduction portion
48 insertion hole
49 locking projection-adhering portion
50 seal lip
51 upper wall
52 lower wall
53 left wall
54 right wall
55 front wall
56 rear wall
57 terminal accommodation chamber
58 engaged portion
59 spacer assembly part
60 engagement part
61 female terminal fitting (terminal fitting)
62 electrical wire
63 electrical contact portion
64 electrical wire connection portion

The invention claimed is:

1. A waterproof connector for engaging with a mating connector, comprising;

an outer housing comprised of a hood portion to be engaged with the mating connector via a front opening and a bottom wall formed and disposed in a rear end position of the hood portion;

an inner housing comprised of accommodation chambers, and configured for insertion into an inside of the hood portion and engagement with the outer housing;

a plurality of electrical wire-equipped terminals comprised of a plurality of terminal fittings accommodated in the accommodation chambers and electrical wire terminals connected to the plurality of terminal fittings; and a packing mat seal in a thick plate shape disposed between the bottom wall and the inner housing, and respectively water-tightly sealing the bottom wall, the inner housing, and the plurality of electrical wire-equipped terminals, wherein the bottom wall integrally includes a locking projection having an arm portion protruding toward the front opening, an engagement convex portion disposed in a protrusion tip side of the arm portion and locking the inner housing, and a mat seal-embedded portion continuous with a proximal end portion of the arm portion, and wherein the packing mat seal is integrally molded to the bottom wall so as to adhere to a circumferential surface of the mat seal-embedded portion.

2. The waterproof connector according to claim 1, wherein the locking projections are respectively formed and arranged in vicinities of inner surfaces of a pair of mutually-opposing side walls in the outer housing, sidewall opening portions configured as pulling-out portions for forming the engagement convex portion outwardly are respectively formed in the pair of side walls, one of the sidewall opening portions being also used as an assembly part for assembling a spacer attachable to the connector, the spacer being inserted into the inner housing so as to traverse the accommodation chambers.

* * * * *